US005487545A

United States Patent [19]

Schindler

[11] Patent Number: 5,487,545

[45] Date of Patent: Jan. 30, 1996

[54] PORTABLE GOLF PUTTING CUP

[76] Inventor: Eric J. Schindler, 9086 Summerhill Point, Alpine, Calif. 91901

[21] Appl. No.: 296,681

[22] Filed: Aug. 26, 1994

[51] Int. Cl.[6] ..... A63B 69/36

[52] U.S. Cl. ..... 273/178 R; 273/34 B; 273/178 A; 273/178 B; 273/180

[58] Field of Search ..... 273/177 R, 179 R, 273/88.1, 34 R, 127 R, 127 B, 181 R

[56] References Cited

U.S. PATENT DOCUMENTS

| | | | |
|---|---|---|---|
| D. 174,253 | 3/1955 | Evans . | |
| D. 242,370 | 11/1976 | Arndt . | |
| D. 273,126 | 3/1984 | Turza . | |
| 1,287,903 | 12/1918 | Daily . | |
| 1,581,092 | 1/1925 | Brooks . | |
| 1,682,601 | 8/1928 | Cunningham . | |
| 3,027,163 | 3/1962 | Saatzer | 273/127 |
| 3,647,216 | 3/1972 | Breslow . | |
| 3,797,833 | 3/1974 | Rokvsek . | |
| 4,906,006 | 3/1990 | Sigunick | 273/34 R |

*Primary Examiner*—V. Millin
*Assistant Examiner*—Charles W. Anderson

[57] ABSTRACT

An improved portable golf putting cup having a circular base (6) and upwardly curved-outer walls (7) that graduate the golf ball (12) into a circular-central depression (S). (FIGS. 1 and 4)

This portable putting cup provides an angled-shock-absorbing lip (9), golf-ball-gripping teeth (10), reclining-inner walls (15), and shock-absorbing material (13). (FIGS. 2–4) The purpose of my improved putting cup is to provide a method of practicing one's putting or engaging in the game of indoor miniature golf by using multiple cups.

2 Claims, 2 Drawing Sheets

Figure 4:
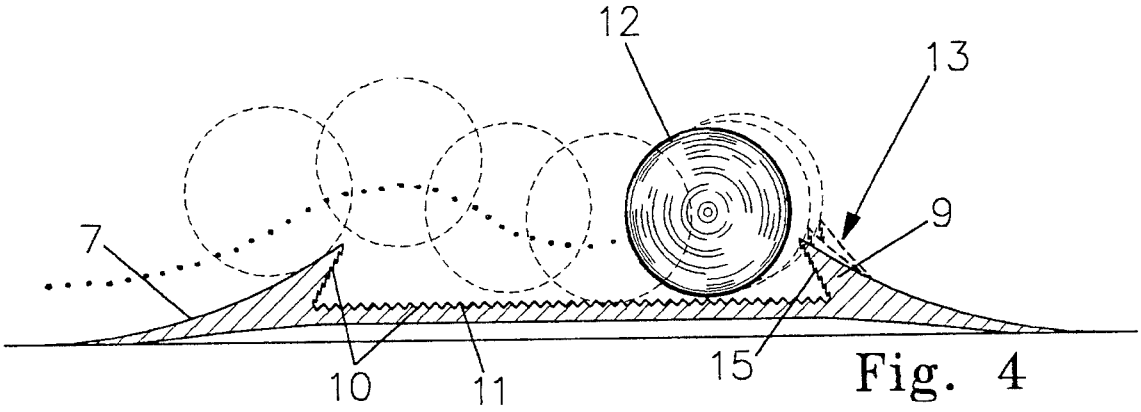

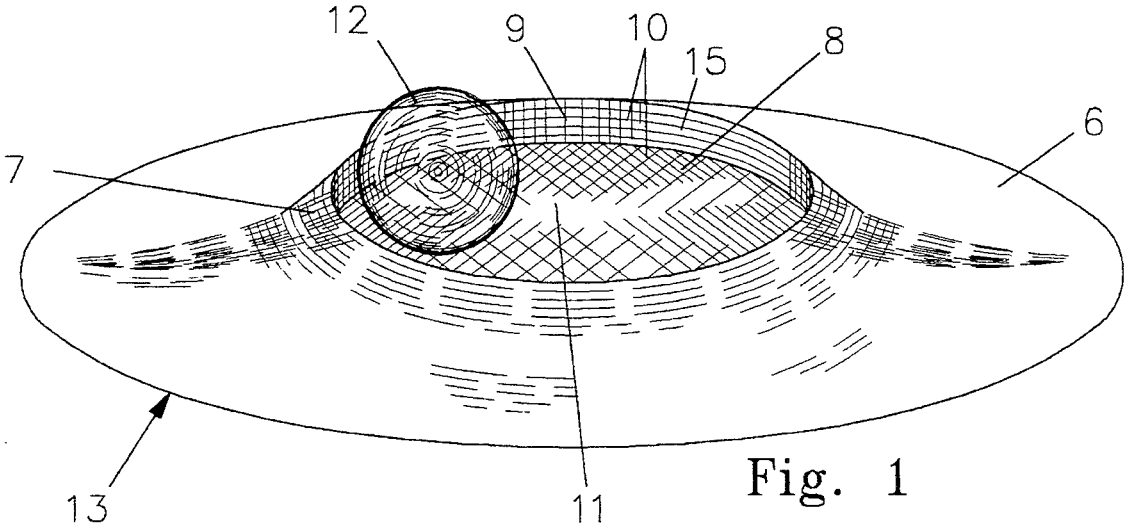
Fig. 1
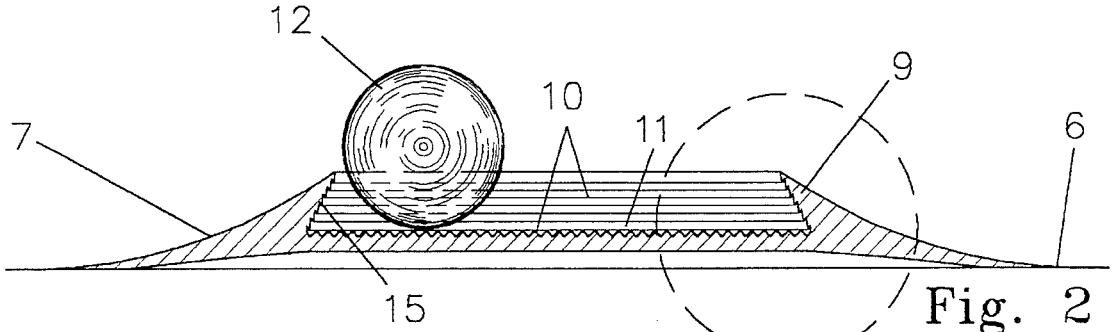
Fig. 2
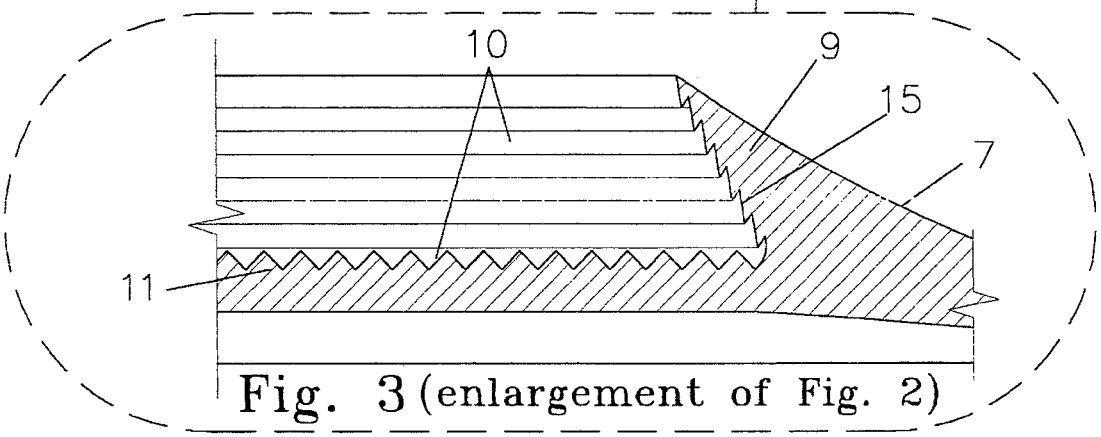
Fig. 3 (enlargement of Fig. 2)

PORTABLE GOLF PUTTING CUP

BACKGROUND—FIELD OF INVENTION

"This invention relates to golf, specifically to an improved portable golf putting cup."

BACKGROUND—DESCRIPTION OF PRIOR ART

The game of golf is and has been enjoyed by thousands of people around the world. To become good at this game, many people practice. One area of practice is in the area of putting. Becoming efficient at putting will significantly reduce one's overall score. Many people do not live near golf courses or would prefer not to drive to one to practice their putting, and hence a need became apparent for a portable indoor/outdoor putting cup.

To try to meet the need, people attempted to produce a realistic putting cup for indoor/outdoor use. Realistic defined as a device that would react similar to a natural putting cup on a standard putting green. However, there are still some major problems with the putting devices that exist today. Each device that is currently available has one or more of the following flaws:

A. The device is not approachable from a 360 degree angle, as seen in Patent Des. 273,126 to Turza, 1984 March 20. While practicing, if one hit the ball past the front of this horseshoe-shaped cup, which is quite common, the ball is now out of play. You must either pick up your ball and move it, or turn that cup around. This unnecessary distraction makes it difficult for one to get a realistic feel of completing a putt.

B. If the device has a round base with a 360 degree approachable angle, and one hits the ball with enough pace to decisively sink the putt then the golf ball can kick out of the cup because the vertical inner walls to the cup cannot hold it. If the vertical inner walls are high enough to hold the ball, then the size of the cup is so large it is prohibitive. (This happens because they have to graduate the incline of the outer walls of the putting cup slowly over a large area to build up the height of the inner walls to attempt to hold the ball in.) An example of these vertical inner walls can be seen in U.S. Pat. No. 1,287,903 to Daily, 1918 December 17.

C. If the putting cup is round with a 360 degree approachable angle, and it can hold a ball hit with pace inside the cup, it does so using some form of artificial means such as an ornamental obstacle that protrudes from the center of the putting cup. This unrealistically restricts or deflects the ball in such a way that the user of the cup cannot effectively reproduce the results of a putting cup on a putting green. An example of this is seen in Patent Des. 174,253 to Evans, 1955 March 22.

D. Putting devices that use alleys or restrictive walls on the outer and inner parts of the cup. This impedes the progression of the ball in such a way that again does not simulate the effects of a regulation putting cup. An example of this is seen in U.S. Pat. No. 1,682,601 to Cunningham, 1928 June 18.

The need still exists for an improved portable putting cup that is approachable from a 360 degree angle and will more effectively reproduce an accurate representation of a regulation putting cup. My improved putting cup will do just this.

OBJECTS AND ADVANTAGES

Accordingly, several objects and advantages of my putting cup include a lightweight and highly portable putting cup that can be used either in or outdoors. This putting cup more realistically reproduces the effects of a putt one would experience while on a regulation putting green. My improved putting cup will reduce or eliminate the problems of the existing putting devices that currently have one or more of the following inherent flaws:

A. Devices that do not have a 360 degree access to the cup, thereby taking the golf ball out of play and hindering the putting to the inside of the cup. This was seen in Patent Des. 273,126 to Turza, 1984 March.

B. Round devices that have vertical inner walls inside the putting device will not sufficiently slow a ball down that is hit with pace. Thereby, allowing the golf ball to kick out of the putting cup. Having to elevate the outer walls of the putting device to build up the vertical inner walls makes the putting cup so large that it would make it restrictive in use. These vertical inner walls are seen in U.S. Pat. No. 1,287,903 to Daily, 1918 December 17.

C. Devices that use an artificial method of impeding the ball's progress to the center of the cup by placing obstacles in the center of the cup, or putting cups, that design alleys or walls on the outer side of the cup thereby deflecting or redirecting the ball in an unnatural way. These examples can be seen in Patent Des. 174,253 to Evans, 1955 March 22 and U.S. Pat. No. 1,682,601 to Cunningham, 1928 June 18.

My improved portable putting cup is round and has a specially designed "angled shock absorbing lip" and reclining-inner walls" covered with "golf-ball-gripping teeth". It is built of a "shock-absorbing material" and has no unnatural obstruction inside the cup or alleys to redirect the ball outside. Because of these improvements, my portable putting cup will substantially reduce and eliminate these previously discussed problems.

This improved putting device can be used in several ways. One or more cups can be set up in or outside the home to create your own putting area. Furthermore, one could place several indoor putting cups throughout their home and create their own indoor miniature golf course. These cups could be placed in such a way to personally fit the contours of one's home. This putting cup can be set up and put away in a time efficient manner. This game could be played with one or more players.

Further objects and advantages of my invention will become apparent from a consideration of the drawings and ensuing descriptions.

DRAWING FIGURES

FIG. 1: A perspective view of my improved golf putting cup.

FIG. 2: A sectioned view slightly elevated from the side.

FIG. 3: An enlarged sectioned side view of the new "angled-shock-absorbing lip" design and "golf-ball-gripping teeth" that cover the "reclining-inner walls" and the inside bottom of the putting cup.

FIG. 4: A sectioned side view illustrating the efficiency of the new "angled-shock-absorbing lip" design and the "golf-ball-gripping teeth" in combination with the "reclining-inner walls" and "flexible-shock-absorbing material."

Figure 5:
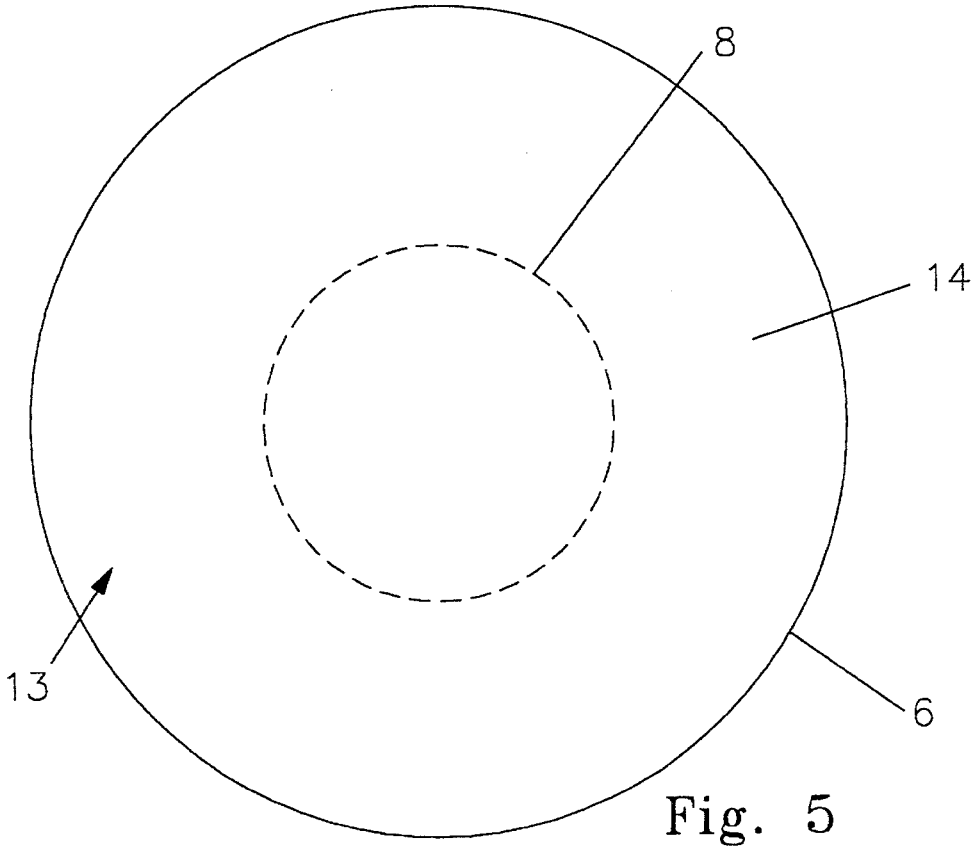

FIG. 5: Shows a view of the flat solid bottom of the putting device, broken lines showing the "circular-central depression" on the reverse side of the putting cup.

REFERENCE NUMERALS IN DRAWINGS

6 Round base of putting cup

7 Curved-outer walls

8 Circular-central depression

9 Angled-shock-absorbing lip

10 Golf-ball-gripping teeth

11 Circular bottom inside cup

12 Golf ball

13 Flexible-shock-absorbing material

14 Flat-solid bottom

15 Reclining-inner walls

DESCRIPTION—FIGS. 1 TO 5

FIG. 1 is a perspective view of my improved portable golf putting cup. A "base" 6 is circular and flat. A "curved-outer wall" 7 curves upward at a gradual angle. An "angled-shock-absorbing lip" 9 is affixed to the "outer walls" 7. A "shock-absorbing-angled lip" 9 is angled upward, leaning toward the "central depression" 8 as seen in FIGS. 2 and 3.

A "central depression" 8 is circular as seen in FIG. 1. Its preferable diameter would be that of a regulation putting cup.

A "golf-ball-gripping teeth" 10 covers the "reclining-inner walls" 15 and "circular bottom" 11 of "central depression" 8 as seen in FIGS. 3 and 4.

A "golf ball" 12 rests on the "golf-ball-gripping teeth" 10 at the "circular bottom" 11 of the putting cup.

OPERATION—FIGS. 1–5

FIG. 1 is a perspective view of my improved Portable Golf Putting Cup. Its "round base" 6 gives it a 360 degree approachable access. A "curved-outer wall" 7 builds resistance as the "golf ball" 12 climbs the "curved-outer wall" 7 to drop into the "circular-central depression" 8. The "circular-central depression" 8 could be the size of a regulation putting cup to create a more realistic effect of putting.

FIG. 2 shows a cross-sectioned-side-view of my improved putting cup and its "angled-shock-absorbing lip" 9, "golf-ball-gripping teeth" 10 on the "inside-circular floor" 11 and the "reclining-inner walls" 15.

FIG. 3 is an enlarged cross-sectioned-side-view of the unique features of my improved putting cup. The "angled-shock-absorbing lip" 9, "reclining-inner walls" 15, and the "golf-ball-gripping teeth" 10. The most unique and important embodiments of my improved golf putting cup is the "angled-shock-absorbing lip" 9 and the "reclining-inner walls" 15, which is shown in FIGS. 2, 3, and 4, and the "golf-ball-gripping teeth" 10 also shown in FIGS. 2, 3, and 4.

The effects of this unique design can be seen in FIG. 4. As the "golf ball" 12 rolls into the central depression, the "golf-ball-gripping teeth" 10 on the "inside-circular floor" 11 and "reclining-inner walls" 15 of the putting cup will grab the golf ball's dimples and slow the ball's rotation. As the ball hits the "angled-shock-absorbing lip" 9, its angled lip design helps keep the ball from jumping out of the cup. The angled lip is made more efficient because of the "reclining-inner walls" 15. Its "flexible-shock-absorbing material" 13, preferably a rubber, vinyl, or flexible plastic absorbs the shock of the "golf ball" 12 as seen in FIG. 4. This "flexible-shock-absorbing material" 13 also helps prevent the ball from jumping out of the "central depression" 8 as seen in FIGS. 1 and 4.

Because the portable golf putting cup has a "flat-solid bottom" 14, as seen in FIG. 5, the portable golf putting cup can be made with no moving parts and out of a single mold, making it cost efficient. It also can rest on almost any surface. Because the entire portable golf putting cup could be made out of the "flexible-shock-absorbing material" 13, it would be lightweight and highly durable since there is no assembly required, it is also easy to set up and use.

SUMMARY, RAMIFICATIONS, AND SCOPE

Accordingly, the reader will see that my improved golf putting cup provides a lightweight, cost effective, and highly portable putting cup that can be used in or outdoors. It more realistically reproduces the effects of a regulation putting cup and can be used by persons of almost any age. One or more of my putting cups can be used for practice or to engage in the game of indoor miniature golf.

While my above description contains many specifications, those should not be misconstrued as limitations on the scope of my invention, but rather as an exemplification of one preferred embodiment thereof.

Many other variations are possible. For example, one could modify the angle of the "angled-shock-absorbing lip". The "lip" could be made longer or shorter to vary the speed of the golf ball. The size and the shape of the "golf-ball-gripping teeth" could be modified to speed up or slow down the golf ball's rotation and speed. The "reclining-inner walls" could be angled higher or lower, and the size of the walls could also be modified to produce different results. The "shock-absorbing material" could be made more pliable or stiff to facilitate a more accurate putting experience. The "upwardly-curved-outer walls" and the "round base" could also be modified in angle and size to create additional reactions to the ball.

Thus, the scope of the invention should be determined by the appended claims and their legal equivalents, rather than by the examples given.

I claim:

1. An indoor/outdoor golf putting cup comprising:

A circular base;

A central depression consisting of a bottom and a reclining inner wall wherein said reclining wall intersects said bottom at an acute angle; an upper surface which inclines from the outer edge of said base to the edge of said reclining inner wall of said central depression; wherein said upper surface and said reclining inner wall having a means for preventing a ball from jumping out of the cup comprising a flexible and shock absorbing material;

A reclining inner wall containing a plurality of ridges to grip the ball and slow it down;

said bottom of said center depression containing a plurality of ridges to grip the ball and slow the rotation of said ball.

2. A putting cup according to claim 1 wherein said cup has no bottom within said central depression.

* * * * *